US008733144B2

(12) United States Patent
Pohl et al.

(10) Patent No.: US 8,733,144 B2
(45) Date of Patent: May 27, 2014

(54) METHOD AND APPARATUS FOR HOT FORMING AND HARDENING A BLANK

(75) Inventors: Martin Pohl, Altenbeken (DE); Markus Pellmann, Sassenberg (DE); Otto Buschsieweke, Paderborn (DE); Stefan Adelbert, Delbrück (DE)

(73) Assignee: Benteler Automobiltechnik GmbH, Paderborn (DE)

( * ) Notice: Subject to any disclaimer, the term of this patent is extended or adjusted under 35 U.S.C. 154(b) by 547 days.

(21) Appl. No.: 12/981,944

(22) Filed: Dec. 30, 2010

(65) Prior Publication Data

US 2012/0006089 A1 Jan. 12, 2012

(30) Foreign Application Priority Data

Jan. 6, 2010 (DE) ..... 10 2010 004 081

(51) Int. Cl.
*B21D 37/16* (2006.01)

(52) U.S. Cl.
USPC ..... 72/364; 72/342.5

(58) Field of Classification Search
USPC ..... 72/46, 47, 342.1, 342.5, 342.6, 342.8, 72/342.94, 364; 148/531, 533; 428/653, 428/659
See application file for complete search history.

(56) References Cited

U.S. PATENT DOCUMENTS

| | | | | |
|---|---|---|---|---|
| 6,290,789 | B1 * | 9/2001 | Toyooka et al. | 148/593 |
| 7,442,268 | B2 * | 10/2008 | Sun | 148/603 |
| 7,540,993 | B2 | 6/2009 | Reinhold et al. | |
| 7,578,894 | B2 | 8/2009 | Reinhold et al. | |
| 8,272,681 | B2 | 9/2012 | Gücker et al. | |
| 2004/0060623 | A1 | 4/2004 | Boke et al. | |
| 2006/0159858 | A1 | 7/2006 | Pohl et al. | |
| 2007/0000709 | A1 | 1/2007 | Pohl et al. | |
| 2007/0163683 | A1 | 7/2007 | Schiessl | |
| 2008/0036124 | A1 | 2/2008 | Adelbert et al. | |
| 2009/0101239 | A1 * | 4/2009 | Nakamura et al. | 148/206 |
| 2009/0126447 | A1 | 5/2009 | Pohl et al. | |
| 2009/0320968 | A1 | 12/2009 | Boeke et al. | |

FOREIGN PATENT DOCUMENTS

| | | |
|---|---|---|
| DE | 24 52 486 | 5/1975 |
| DE | 101 08 926 C1 | 1/2003 |
| DE | 102 08 216 C1 | 3/2003 |
| DE | 102 56 621 B3 | 4/2004 |
| DE | 102004007071 | 9/2005 |
| DE | 102007024797 | 11/2008 |
| DE | 102008006248 | 7/2009 |
| GB | 1 490 535 | 11/1977 |

OTHER PUBLICATIONS

"22MnB5 Gergütungsstahl, borlegiert" in: SZFG Werkstoffblatt 11-112, Salzgitter Flachstahl, Germany, Jun. 22, 2011.

Kurt Steinhoff et al.: „Moderne thermomechanische Prozessstrategien in der Stahlumformung, in: Stahlinstitut VDEh, 2007.

* cited by examiner

*Primary Examiner* — Teresa M Ekiert
(74) *Attorney, Agent, or Firm* — Henry M Feiereisen LLC

(57) ABSTRACT

A blank cut from a strip of hardenable hot-formed steel is heated in a furnace to a temperature which is smaller than an $Ac_3$ transformation point in an iron carbon diagram. A first region of the blank is then heated in a conductive heating station to a temperature above the $Ac_3$ transformation point and subsequently hardened in a hot forming and hardening tool to produce a steel part with at least two microstructured regions of different ductility.

11 Claims, 3 Drawing Sheets

METHOD AND APPARATUS FOR HOT FORMING AND HARDENING A BLANK

CROSS-REFERENCES TO RELATED APPLICATIONS

This application claims the priority of German Patent Application, Ser. No. 10 2010 004 081.9, filed Jan. 6, 2010, pursuant to 35 U.S.C. 119(a)-(d), the content of which is incorporated herein by reference in its entirety as if fully set forth herein.

BACKGROUND OF THE INVENTION

The present invention relates to a method and apparatus for hot forming and hardening a workpiece such as a flat or preformed steel blank.

The following discussion of related art is provided to assist the reader in understanding the advantages of the invention, and is not to be construed as an admission that this related art is prior art to this invention.

In the field of vehicle construction, more and more vehicle parts made of high-strength and ultra-high-strength steel are being employed in order to be able to satisfy criteria for light-weight construction. This applies in particular to vehicle body construction where, in order to meet weight goals and safety requirements, i.a. structural and/or safety elements such as door impact beams, A and B columns, bumpers, side rails, and cross rails, are increasingly produced from hot formed and press-hardened steel having tensile strengths greater than 1000 MPa.

Published German patent document DE 24 52 486 C2 describes a method for press-shaping and hardening a steel sheet that is relatively thin and has good dimensional stability. A sheet made of boron-alloyed steel is heated to a temperature above its upper $Ac_3$ transformation point in the iron carbon diagram (hereinafter referred to as "I-C-D") and then in less than 5 seconds is pressed into the final shape between two indirectly cooled tools that change its shape significantly, and, while still in the press is subjected to rapid cooling such that a martensitic or bainitic structure is obtained. Using these measures produces a product which has good shape accuracy, good dimensional stability, and high strength, and which is well suited for structural and safety elements in vehicle construction. This process is hereinafter referred to as hot forming and press-hardening. Both preformed parts as well as flat blanks can be hot formed and press-hardened. In preformed parts, the forming process can also be limited to a shaping of a small percentage of the final geometry or to calibration.

Different applications in the automobile industry require the production of formed parts of high strength in certain regions while having a comparably higher ductility in other regions. In addition to reinforcing with additional metal sheets or joining parts that have different strengths, it is also known to heat-treat a formed part in such way as to exhibit local regions of higher strength or higher ductility.

Published U.S. patent document US 2004/0060623 describes a method of producing a hardened metal part having at least two regions with different ductility. A flat or preformed blank is heated to an austenitization temperature in a heating device and then transported along a transport path to a hardening process. During transport, first regions of the flat or preformed blank that have higher ductility properties in the final part are cooled. The method is optimized for mass production by quenching the first regions from a predetermined cooling start temperature that is greater than the $\gamma$-$\alpha$ transformation temperature in the I-C-D, and by terminating quenching when a predetermined cool stop temperature is attained before any transformation into ferrite and/or perlite has occurred or after only a slight transformation into ferrite and/or perlite has taken place. Then, the workpiece is maintained approximately under isothermal condition for converting the austenite to ferrite and/or perlite, while the hardening temperature in second regions which have comparably lower ductility properties in the final product, is kept just high enough for sufficient martensite formation in the second regions during a hardening process. Thereafter, the hardening process is performed. In this method, more thermal energy is added to the first regions of the flat or preformed blank than is necessary, and thermal energy is removed in a second process step, which also consumes energy. The method therefore has a relatively poor energy balance.

German Pat. No. DE 101 08 926 C1 discloses a thermal treatment process for changing the physical properties of a metal article. The article is irradiated, at least in a predetermined surface section, with electromagnetic radiation from an emitter having a radiator temperature of 2,900 K or more in the near infrared range with a high power density. As a result, the material of a surface layer is heated to a predetermined treatment temperature in dependence on material parameters. Then the irradiated surface region is actively cooled and thus hardened and tempered. However, completely heating an article that has a large surface area from room temperature to hardening temperature using this method would be too uneconomical for an industrial hot forming line.

U.S. Pat. No. 7,540,993 discloses a method for producing a formed part that has at least two regions with different ductility from a semifinished product made of hardenable steel by heating in a continuous furnace followed by a hardening process. During transport through a continuous furnace, the semifinished product to be heated simultaneously passes through at least two zones in the continuous furnace that are adjacent one another in the travel direction and that have different temperature levels and thus are heated differently so that in a subsequent hardening process at least two structural regions are created that have different ductility. Both zones are separated from one another by a partition such that a workpiece passing through the furnace has parts in both zones so separate temperature control is possible in each zone. However, this multizone furnace is a special furnace for parts that are to be heated zone-wise.

It would therefore be desirable and advantageous to provide an improved method and apparatus for making a blank with differently hardened regions in a hot forming line to obviate prior art shortcomings and to realize a press cycle which is as economical as possible.

SUMMARY OF THE INVENTION

According to one aspect of the present invention, a method includes the steps of heating a flat or preformed blank of steel in a furnace to a temperature which is smaller than an $Ac_3$ transformation point in an iron carbon diagram, heating a first region of the blank in a conductive heating station to a temperature above the $Ac_3$ transformation point, and hardening the first region of the blank in a hot forming and hardening tool to produce a steel part with at least two regions of different ductility.

According to another aspect of the present invention, a method includes the steps of coating a flat or preformed blank of steel with an alloy, heating the blank in a furnace to a temperature which is smaller than an $Ac_3$ transformation point of the alloy in an iron carbon diagram, heating a first region of the blank in a heating station having at least one open burner, e.g. an open oil or gas burner, to a temperature above the $Ac_3$ transformation point, and hardening the first region of the blank in a hot forming and hardening tool to produce a steel part with at least two regions of different ductility.

As a result, a blank of steel can be produced with at least two microstructural regions of different ductility. Using a conventional furnace, for example a continuous furnace, different hardened blanks can be produced in a hot forming line. The forming process can also be limited to shaping a small percentage of the final geometry or to a calibration of the blank.

In hot forming and press-hardening, a defined amount of heat must be applied to the blank. Any region that is to undergo a substantially complete structural transformation into martensite as a result of hardening must be heated beforehand to a temperature that is greater than or equal to the $Ac_3$ transformation point. This region is referred to hereinafter as a first region. Regions that are not hardened or at least not completely hardened, are referred to hereinafter as second regions and should not be heated to a temperature above the $Ac_3$ transformation point. For press-hardening, it would be sufficient if the second regions are at room temperature. This is also beneficial for energy reasons, although steel is significantly less malleable at room temperature than heated steel. Therefore, at least for more complex deep-drawn parts, it is suitable for the forming process that the steel be heated even in the second regions, especially since common hot-formed steel springs back after undergoing cold forming, which adversely affects tolerances that are to be maintained. In addition, if the temperature gradient between the first region and the second regions is too great, stress is produced in the transition region after hardening.

According to another advantageous feature of the present invention, the blank may be heated in the furnace to a maximum temperature commensurate with an $Ac_1$ transformation point in the iron carbon diagram. As a result, formation of martensite is prevented in the second regions after hardening. Once the $Ac_1$ transformation point has been exceeded, a partial microstructural transformation begins that after hardening can also lead to partial martensite formation, which is not desired. Conversely, conductive heating or heating with open burners (referred to hereinafter in short as "heating") should not last too long. Therefore, the start temperature for heating should be as high as possible. Consequently the entire blank is suitably heated in the furnace to a homogeneous temperature up to a maximum commensurate with the $Ac_1$ transformation point and then transferred to the $Ac_3$ transformation point. At the same time, the second regions are not heated at all or merely maintained at their temperature. In this manner, heating is performed rapidly enough to ensure the production sequence in the press cycle. In the event, heating of the first region to a temperature above the $Ac_3$ transformation point is slower than the press cycle, the presence of two or more heating stations is necessary. It is therefore an advantage of the inventive method that it is possible to retain conventional continuous furnaces in a conventional production line for hot forming and to be able to simply and economically retrofit the conventional line for production of a blank with regions of different hardness. In addition, in an existing production line, it is possible to construct the continuous furnace simpler and more economically overall as the furnace has to reach only temperatures up to $Ac_1$ and not above $Ac_3$ and is thus able to better withstand these temperatures in continuous operation.

According to another advantageous feature of the present invention, the blank may be heated overall in the furnace to a homogenous temperature below the $Ac_3$ transformation point but greater than the $Ac_1$ transformation point, and may then be transferred to the heating station in which the first region is heated to a temperature above the $Ac_3$ transformation point. After hardening, a mixed structure occurs in the second regions and involves properties between the properties of the initial microstructure and the properties of the hard structure. This mixed structure is beneficial for certain applications. The blank parameters can therefore be flexibly adjusted as needed and thus increase the power of the heating station.

According to another advantageous feature of the present invention, the blank may be made of a steel alloy which comprises in weight percent:

| | |
|---|---|
| Carbon (C) | 0.18% to 0.3% |
| Silicon (Si) | 0.1% to 0.7% |
| Manganese (Mn) | 1.0% to 2.5% |
| Phosphorus (P) | maximal 0.025% |
| Chromium (Cr) | up to 0.8% |
| Molybdenum (Mo) | up to 0.5% |
| Sulfur (S) | maximal 0.01% |
| Titanium (Ti) | 0.02% to 0.05% |
| Boron (B) | 0.002% to 0.005% |
| Aluminum (Al) | 0.01% to 0.06%, and |
| balance iron and impurities resulting from smelting. | |

The steel alloy may involve an uncoated hot-formed steel which has been alloyed with boron. A blank of such a steel is first heated homogeneously to at least 400° C., preferably to about 700° C., and then is heated in the first region to a temperature of about 930° C. by conductive heating or heating with open burners, while the second regions are maintained at approximately 700° C. Immediately following the heating, the blank is transferred to a hot forming and hardening tool and shaped and hardened in the first region. As a result, a hot formed blank is realized which has regions of different hardness and is dimensionally accurate, and thus has defined properties in the first and second regions.

According to another advantageous feature of the present invention, the blank may be provided with a metallic coat which is fully alloyed before being heated in the furnace. The metallic coat may be made of aluminum or zinc. When a hot-formed steel is involved which is coated with a layer containing aluminum, the hot-formed steel should initially be heated to a temperature above the $Ac_3$ transformation point and fully alloyed in order to form a so-called intermetallic phase. Thus, the hot-formed steel coated with aluminum is fully alloyed in a separate work step in order to attain a cost-effective process. Suitably, this work step is performed by a steel manufacturer when the coil is produced.

According to another advantageous feature of the present invention, the heating station may include different temperature fields which are separated from one another by a shield.

BRIEF DESCRIPTION OF THE DRAWING

Other features and advantages of the present invention will be more readily apparent upon reading the following description of currently preferred exemplified embodiments of the invention with reference to the accompanying drawing, in which.

DETAILED DESCRIPTION OF PREFERRED EMBODIMENTS

Figure 1:
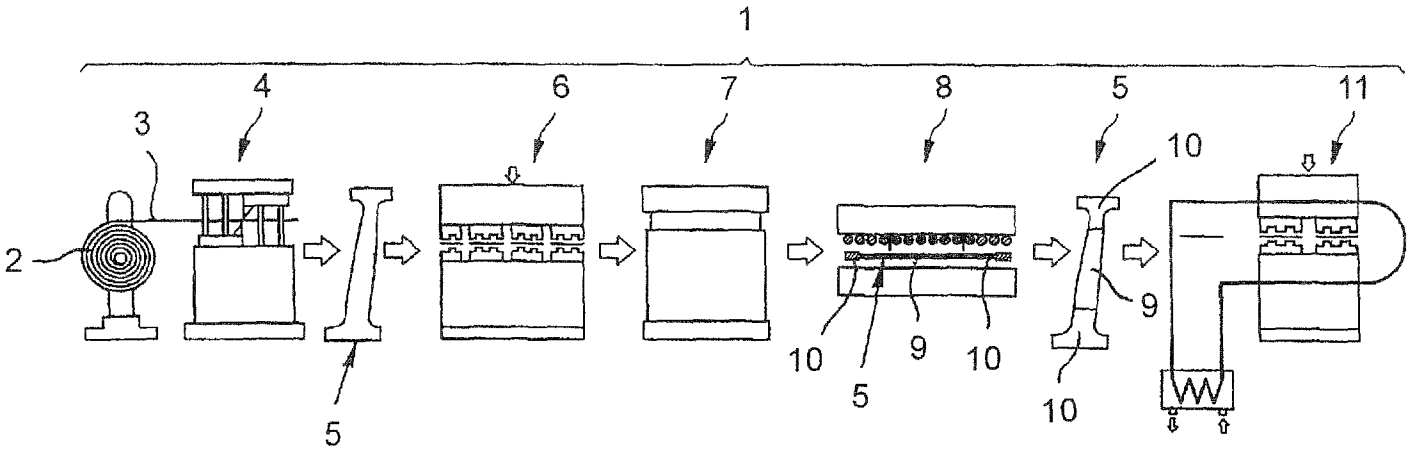
FIG. 1 is a schematic illustration of one embodiment of a hot forming line according to the present invention for producing a blank made of uncoated steel.

Throughout all the figures, same or corresponding elements may generally be indicated by same reference numerals. These depicted embodiments are to be understood as illustrative of the invention and not as limiting in any way. It should also be understood that the figures are not necessarily to scale and that the embodiments are sometimes illustrated by graphic symbols, phantom lines, diagrammatic representations and fragmentary views. In certain instances, details which are not necessary for an understanding of the present invention or which render other details difficult to perceive may have been omitted.

Turning now to the drawing, and in particular to FIG. 1, there is shown a schematic illustration of one embodiment of a hot forming line according to the present invention, generally designated by reference numeral 1 and including a coil; 2 on which uncoated hot-formed steel 3 is wound and continuously unwound and cut to size in a cutting station 4 to create blanks 5. The blanks 5 can be selectively preformed cold and/or can be cut in a forming station 6. Cold forming normally involves deep-drawing at room temperature, and trimming is done as close to the final contours as possible. The forming station 6 is optional and depends on the complexity of the geometry of the workpiece. The forming station may also be eliminated altogether.

The blanks 5 are then transferred to a furnace, e.g. a continuous furnace 7. In the furnace 7, the blanks 5 are homogeneously heated to a temperature below the upper $Ac_3$ transformation point in the iron carbon diagram and then immediately transferred to a heating station 8. The heating station 8 is shown here by way of example as a separate station. Of course, the heating station may also be integrated into the furnace 7, for example in an end region of the furnace 7. In the heating station 8, a first region 9 of the blanks 5 is heated to a temperature above the $Ac_3$ transformation point. Second regions 10 remain at a temperature that is below the $Ac_3$ transformation point.

The furnace 7 as well as the heating station 8 may be operated conductively. As an alternative, open burners with gas or oil may also be used.

Figure 3:
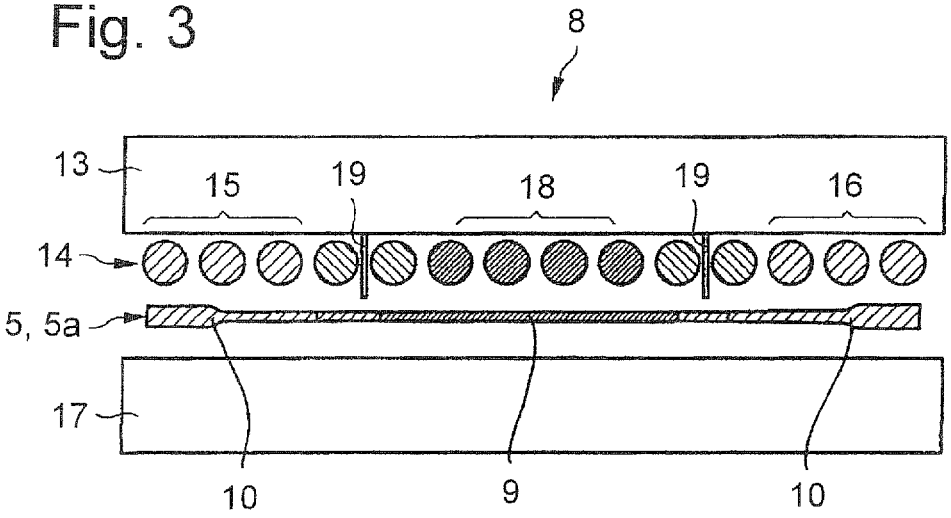
FIG. 3 a schematic section, on an enlarged scale, of a heating station of the hot forming line of FIGS. 1 and 2.

As shown in particular in FIG. 3, the second regions 10 are situated at each end of the blanks 5, whereas the first region 9 is situated in the center of the blanks 5. The thus pre-heated blanks 5 are then fed to a force-cooled forming and hardening tool 11 and hot-formed as well as differentially hardened there.

Figure 2:
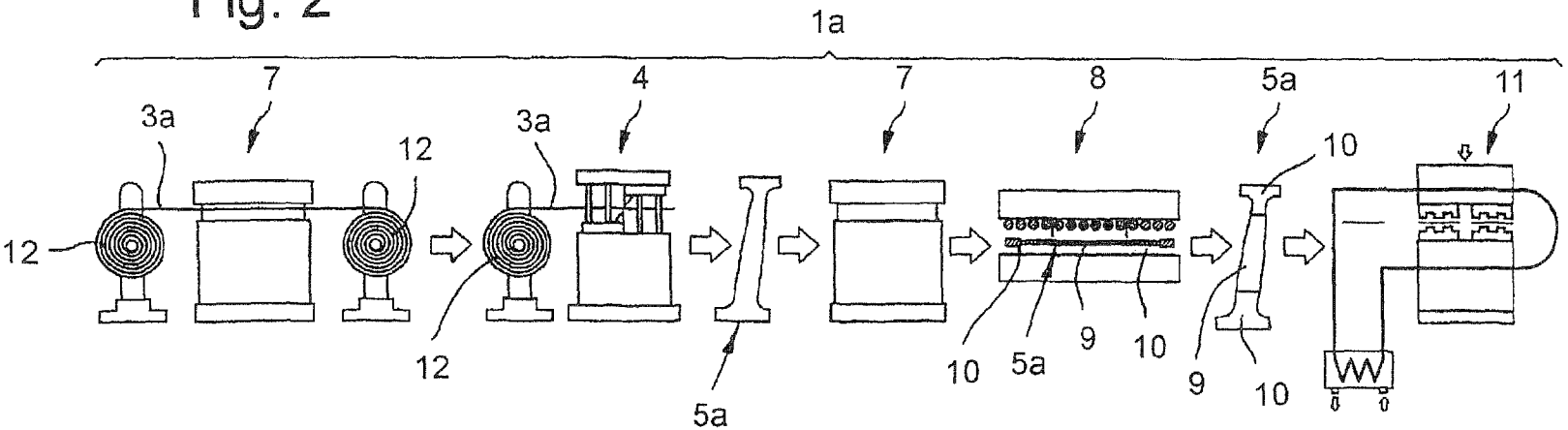
FIG. 2 is a schematic illustration of another embodiment of a hot forming line according to the present invention for producing a blank made of coated steel.

FIG. 2 shows a schematic illustration of another embodiment of a hot forming line according to the present invention, generally designated by reference numeral 1*a*. Parts corresponding with those in FIG. 1 are denoted by identical reference numerals and where appropriate by corresponding reference numerals followed by an "a". A coil 12 of hot-formed steel 3*a* which is coated with an alloy containing aluminum is continuously unwound and transported through a continuous furnace 7. In the continuous furnace 7, the coated hot-formed steel 3*a* is homogeneously heated to a temperature above the $Ac_3$ transformation point so that the coating is completely alloyed and forms with the base metal a so-called intermetallic phase. The heated coated steel 3*a* is not quenched at this point to prevent hardening. Otherwise, its resistance to deformation would be too high for further processing. When leaving the continuous furnace 7, the fully alloyed coated steel 3*a* is re-wound onto a coil 12.

The coated steel 3*a* is then continuously unwound from the coil 12 and cut to size in a cutting station 4 to create coated blanks 5*a*. In contrast to the hot forming line 1 of FIG. 1, there is no forming station for cold forming because the intermetallic phase realized during the complete alloying process cannot be cold shaped without cracking. Therefore, the blanks 5*a* are transferred directly to the continuous furnace 7. In the continuous furnace 7, the coated blanks 5*a* are homogeneously heated to a temperature that is below the $Ac_3$ transformation point and then immediately transferred to a heating station 8 operated conductively or with gas or oil burners. The heating station 8 is again shown as a separate station, but may, of course, also be integrated into the continuous furnace 7, for example in an end area thereof. In the heating station 8, the first region 9 in midsection of the blanks 5*a* is heated to a temperature above the $Ac_3$ transformation point, whereas the terminal second regions 10 remain at a temperature below the $Ac_3$ transformation point. The thus pre-heated blanks 5*a* are then transferred to a force-cooled forming and hardening tool 11 and hot formed as well as differentially hardened.

FIG. 3 shows a schematic section, on an enlarged scale, of the heating station 8 of the hot forming line 1, 1*a* of FIGS. 1 and 2. Conductors 14 are attached to a mounting 13 and controlled in outer temperature fields 15, 16 such as to maintain the second regions 10 of a pre-formed pre-heated blank 5, 5*a* on a mounting 17 at a temperature of about 700° C. In the center temperature field 18, the conductors 14 are controlled such as to heat the first region 9 in midsection of the blanks 5, 5*a* to a temperature of about 930° C. As shown in FIG. 3, the temperature fields 15, 16, 18 are separated from one another by shields 19. The shields 19 enable easier control of the temperature distribution in the blanks 5, 5*a* and a more precise adjustment of the hardness values in the finished product. (FIG. 4)

Figure 4:
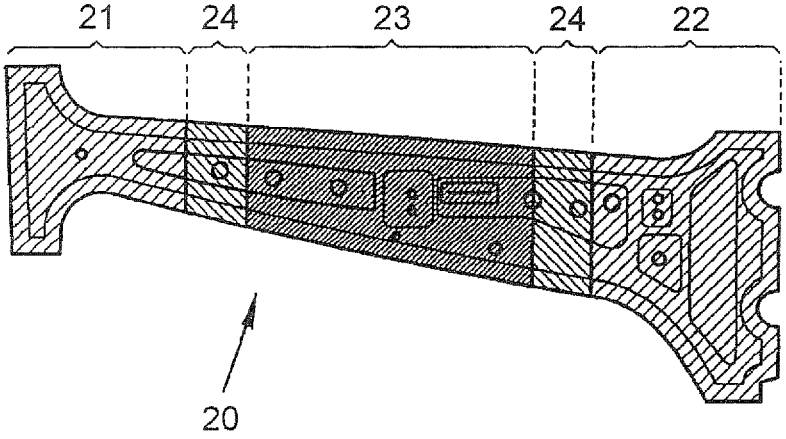
FIG. 4 is a sectional view of a blank for use as a B column for a motor vehicle, illustrating a hardness distribution in the blank.

As shown in FIG. 4, after hot forming and hardening, a B column 20 having regions of different hardness has been created from the blanks 5, 5*a* in accordance with FIG. 3. The B column 20 is relatively ductile in a head area 21 and a foot area 22, and hardened in the center region 23. A mixed structure is created in transition regions 24 from the hardened center region 23 to the unhardened end regions 21, 22.

Figure 5:
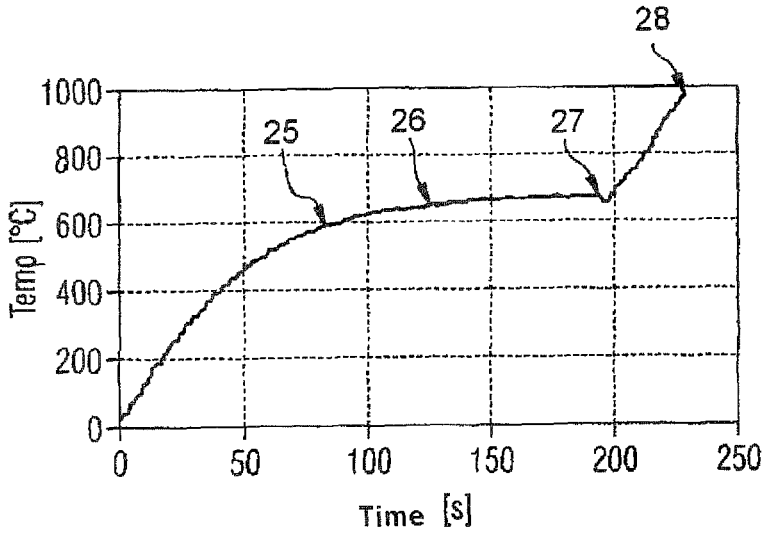
FIG. 5 is a graphical illustration of a heating curve for a first region of the blank, showing the temperature profile as a function of the time.

FIG. 5 shows a heating curve 25 for the first region 9 of a blank 5, 5*a*. The temperature is shown in degree Celsius over time in seconds. The curve area 26 shows a continuous heating of the blanks 5, 5*a* in a continuous furnace 7. The entire blank 5, 5*a* is homogeneously heated from room temperature to about 700° C. in just under 200 seconds. At curve point 27, the blank 5, 5*a* is transferred to a conductive heating station 8 and heated within about 30 seconds to just under 930° C. Heating of the blank 5, 5*a* concludes at curve point 28.

While the invention has been illustrated and described in connection with currently preferred embodiments shown and described in detail, it is not intended to be limited to the details shown since various modifications and structural changes may be made without departing in any way from the spirit and scope of the present invention. The embodiments were chosen and described in order to explain the principles of the invention and practical application to thereby enable a person skilled in the art to best utilize the invention and various embodiments with various modifications as are suited to the particular use contemplated.

What is claimed as new and desired to be protected by Letters Patent is set forth in the appended claims and includes equivalents of the elements recited therein:

What is claimed is:

1. A method, comprising the steps in the order of:

providing a flat or preformed blank of steel having a fully alloyed metallic coat:

heating the blank in a furnace to a maximum temperature commensurate with an $Ac_1$ transformation point;

heating a first region of the blank in a conductive heating station to a temperature above an $Ac_3$ transformation point; and hardening the first region of the blank in a hot forming and hardening tool to produce a steel part with at least two regions of different ductility.

2. The method of claim 1, wherein the furnace is constructed in the form of a continuous furnace.

3. The method of claim 1, wherein the blank is made of a steel alloy which comprises in weight percent:

| | |
|---|---|
| Carbon (C) | 0.18% to 0.3% |
| Silicon (Si) | 0.1% to 0.7% |
| Manganese (Mn) | 1.0% to 2.5% |
| Phosphorus (P) | maximal 0.025% |
| Chromium (Cr) | up to 0.8% |
| Molybdenum (Mo) | up to 0.5% |
| Sulfur (S) | maximal 0.01% |
| Titanium (Ti) | 0.02% to 0.05% |
| Boron (B) | 0.002% to 0.005% |
| Aluminum (Al) | 0.01% to 0.06%, and |
| balance iron and impurities resulting from smelting. | |

4. The method of claim 1, wherein the metallic coat is made of zinc or aluminum.

5. The method of claim 1, wherein the heating station includes different temperature fields separated from one another by a shield.

6. A method, comprising the steps in the order of:

providing a flat or preformed blank of steel having a fully alloyed metallic coat;

heating the blank in a furnace to a maximum temperature commensurate with an $Ac_1$ transformation point;

heating a first region of the blank in a heating station having at least one open burner to a temperature above an $Ac_3$ transformation point; and hardening the first region of the blank in a hot forming and hardening tool to produce a steel part with at least two regions of different ductility.

7. The method of claim 6, wherein the burner is an oil burner or a gas burner.

8. The method of claim 6, wherein the furnace is constructed in the form of a continuous furnace.

9. The method of claim 6, wherein the blank is made of a steel alloy which comprises in weight percent:

| | |
|---|---|
| Carbon (C) | 0.18% to 0.3% |
| Silicon (Si) | 0.1% to 0.7% |
| Manganese (Mn) | 1.0% to 2.5% |
| Phosphorus (P) | maximal 0.025% |
| Chromium (Cr) | up to 0.8% |
| Molybdenum (Mo) | up to 0.5% |
| Sulfur (S) | maximal 0.01% |
| Titanium (Ti) | 0.02% to 0.05% |
| Boron (B) | 0.002% to 0.005% |
| Aluminum (Al) | 0.01% to 0.06%, and |
| balance iron and impurities resulting from smelting. | |

10. The method of claim 6, wherein the metallic coat is made of zinc or aluminum.

11. The method of claim 6, wherein the heating station includes different temperature fields separated from one another by a shield.

* * * * *